United States Patent [19]

Duran et al.

[11] Patent Number: 4,754,519

[45] Date of Patent: Jul. 5, 1988

[54] VACUUM CANISTER

[75] Inventors: David C. Duran, Cedar Rapids; John P. Casey, Shellsburg; James G. Marion; M. Allen McGrew, both of Cedar Rapids, all of Iowa

[73] Assignee: D.A.D. Manufacturing Co., Inc., Hiawatha, Iowa

[21] Appl. No.: 67,189

[22] Filed: Jun. 29, 1987

[51] Int. Cl.[4] ..... A47L 5/38

[52] U.S. Cl. ..... 15/314; 15/327 R; 15/339; 194/239; 194/904

[58] Field of Search ..... 15/314, 339, 327 R, 15/352; 194/239, 904

[56] References Cited

U.S. PATENT DOCUMENTS

| | | | |
|---|---|---|---|
| 3,910,781 | 10/1975 | Bryant | 15/314 X |
| 4,036,346 | 7/1977 | Livingston | 15/339 X |
| 4,194,262 | 3/1980 | Finley et al. | 15/339 X |
| 4,202,070 | 5/1980 | Harfst | 15/339 X |

*Primary Examiner*—Chris K. Moore

*Attorney, Agent, or Firm*—Allan L. Harms

[57] ABSTRACT

An improved coin operated vacuum cleaner canister with coin mechanism is disclosed. A blank having a polygonal or rectangular opening is rolled into a canister sidewall. A frame comprising a plurality of straps defining a polygon with an open side is mounted within the opening in the sidewall with the frame depending from the opening into the interior of the canister. A coid mechanism enclosure is detachably mounted to said frame such that a coin mechanism and coin container are receivable within the enclosure. The enclosure includes a flange which surrounds the opening of the enclosure and overlies the sidewall surrounding the opening in the sidewall. The flange is curved generally codiametrically to the sidewall. An alternative embodiment provides a coin duct disposed within the canister for passage of coins handled by the coin mechanism from the coin mechanism into a vault mounted in the base on which the vacuum cleaner is mounted.

12 Claims, 3 Drawing Sheets

FIG 1
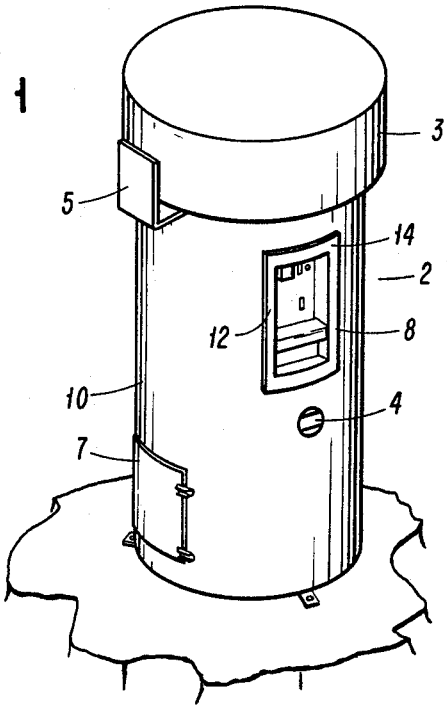
FIG 2
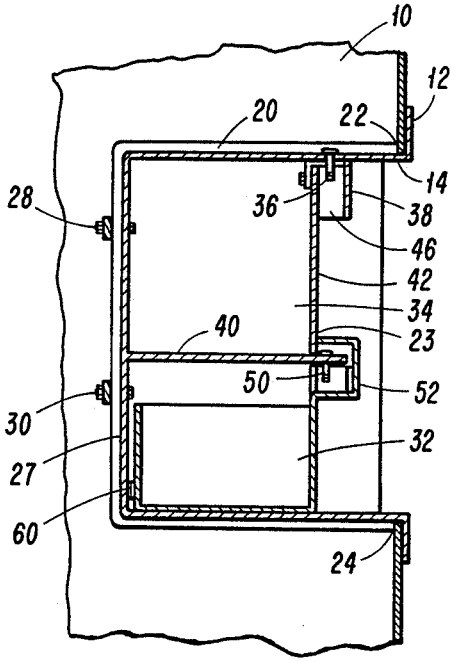
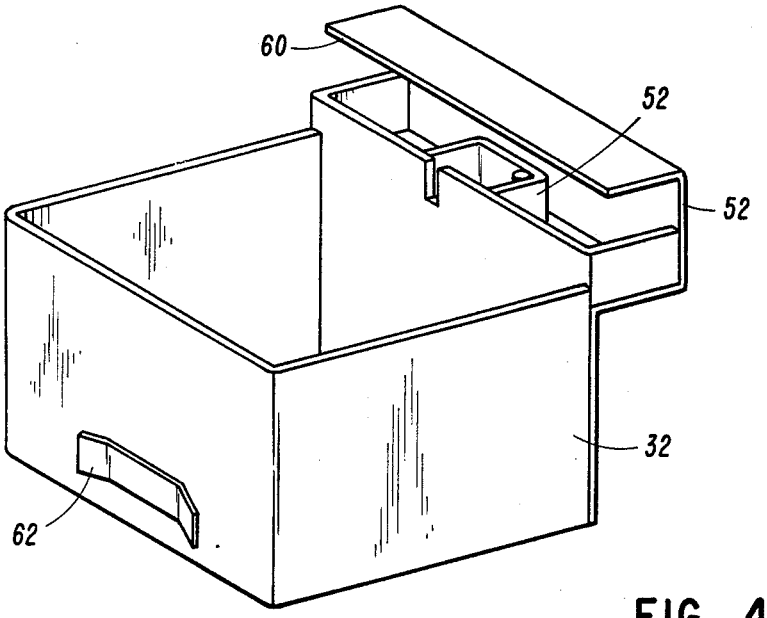
FIG 4

VACUUM CANISTER

BACKGROUND OF THE INVENTION

The instant invention pertains to vacuum cleaners and in particular to coin operated, commercial vacuum cleaner canisters and the coin mechanisms associated therewith.

Car wash facilities for consumer automobiles have typically included some provision for self service use of vacuum cleaning apparatus. Such devices have recently become revenue production devices with the inclusion of coin mechanisms to provide means for charging for use of the vacuum cleaning device. The proliferation of so-called "convenience" stores has also increased the demand for vacuum cleaning machines available to the public for use in cleaning interiors of motor vehicles of all kinds. Particularly in the setting of a "convenience" store, a coin-operated, self-service vacuum cleaner is desirable.

Existing vacuum cleaners are frequently made from sheet steel rolled into a cylindrical canister with a top and bottom. The vacuum motor works upon the cavity of the canister to create a reduced air pressure therein in order to effect the desired suction within hoses styled to communicate with the canister's interior. Coin mechanisms are usually welded to the outside of the canister in order to make them convenient to the user and for appropriate connection to control the vacuum cleaning device. However, with the coin mechanism mounted to the outer surface of the canister, the security of the coin device is at risk due to the access to a thief or vandal to much of the outside of the body of the coin mechanism.

Additionally, with the coin mechanism mounted to the exterior of the canister, the most feasible location for a receptacle to collect coins inserted in the coin mechanism is within the coin mechanism itself.

Earlier attempts at providing a coin mechanism which does not extend from the outside of the canister body have been thwarted by difficulty in feasibly and economically mounting the coin box within a recess in the canister sidewall. It is well known that the rolling of a sheet metal blank having a rectangular opening therein results in a cylindrical body which no longer has a true rectangular opening. Discontinuities in the roll develop surrounding the opening. Tedious and expensive welding measures are necessary to successfully mount the coin mechanism into the nonrectangular opening. Unless a non-standardized coin mechanism having a curved front panel were developed to be used, an uneven and displeasing weldment results, additionally suffering from a tendency to allow air leakage at the welds.

SUMMARY OF THE INVENTION

An improved vacuum canister and coin mechanism is provided. A blank of stainless steel is provided with an opening sized to receive the body of a coin mechanism. The blank is rolled by well known means into a cylindrical shape and the ends are welded together. Top and base members are provided to enclose the cylinder.

An open frame is welded within the opening provided in the blank. A coin mechanism enclosure having a shape and size substantially similar to the shape and size of the opening in the blank is insertable into said open frame. The coin mechanism enclosure is provided with peripheral flanges extending therefrom. Mounting means are provided to retain said enclosure to the open frame. Coin mechanism means and coin box means are retainable within said enclosure by selective means. In an alternative embodiment the coin mechanism is provided with a passageway within the canister to enable passage of deposited coins into a vault positioned below the base of the invention.

It is an object of the invention to provide a vacuum canister with improved security for the coin mechanism and coin box.

Another object of the invention is to provide a vacuum canister having a recessed coin mechanism.

Another object of the invention is to provide a vacuum canister having a removable yet secure coin mechanism.

Another object of the invention is to provide a vacuum canister providing for collection of coins in a vault below the canister.

These and other objectives of the invention will be apparent from examination of the detailed description which follows.

DESCRIPTION OF THE DRAWING FIGURES

FIG. 1 is a perspective view of the invention with associated accessories and dome in place.

FIG. 2 is a cross section of the coin mechanism assembly of the invention.

FIG. 4 is a perspective view of the coin container from the rear.

DETAILED DESCRIPTION OF THE INVENTION

Figure 3:
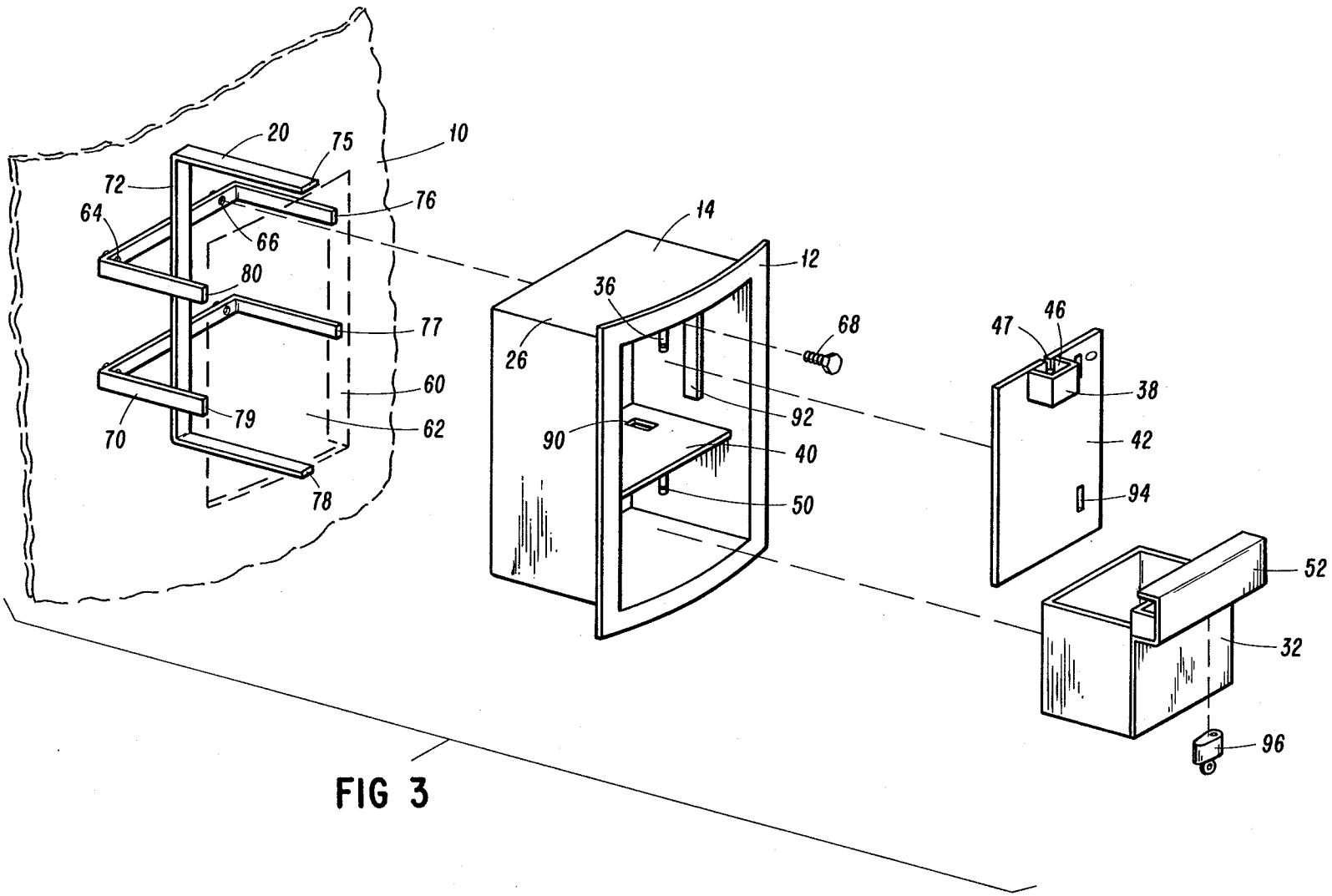
FIG. 3 is an exploded view of the coin mechanism and frame of the invention.

Referring to FIGS. 1–4, the preferred embodiment of the invention 2 is disclosed. In FIG. 1, the invention 2 is provided with accessories including lid 3, bracket 5, and door 7. Suction opening 4 is provided to allow attachment of a hose or other duct apparatus such that the cavity of invention 2 communicates with the interior of such hose or like duct apparatus. Coin mechanism assembly 8 is in assembled position within sidewall 10 of invention 2. Flange 12 extends from enclosure 14 of coin mechanism assembly 8.

In FIG. 2, the novelty of features and interrelationships of functional elements can be seen. Open frame 20 is secured to sidewall 10 including at points 22 and 24 by welding or other permanent means. Enclosure 14 is fixed to open frame 20 by detachable mounting means such as bolts 28 and 30. Flange 12 comprises the outer periphery of enclosure 14 and overlies sidewall 10 adjacent to the opening therein. Because the canister of the preferred embodiment is preferably rolled from a blank of steel and preferably grade 304 stainless steel, the opening of the blank is subject to loss of continuity and curvature as the blank is rolled into cylindrical sidewall 10. This loss of proper shape has prevented economically feasible implementation of the recessed coin apparatus in earlier devices. The use of flange 12 on enclosure 14 allows simplified mounting and more effective sealing between sidewall 10 and enclosure 14. Welding of enclosure 14 to sidewall 10 is made unnecessary by mounting bolts 28 and 30 through welding or adhesive could also be used. The use of mounting bolts 28 and 30 allows field repairs of coin mechanism enclosures 14 which become vandalized.

Coin container 32 rests within enclosure 14 disposed to receive coins from coin mechanism cavity 34 which is formed by enclosure 14, shelf 40 and front panel 42. No coin mechanism detail is depicted in cavity 34 of the drawings in the interest of simplification of the drawings and because no claim to the coin mechanism itself is made.

Shield 38 can be seen to surround pin receiving area 46 of front panel 42. Lock means are to be employed to capture pin 36 within shield 38 thereby retaining front panel 42 to enclosure 14. Similarly, coin container 32 is retained to enclosure 14 by a second pin 50 depending downward from shelf 40 of enclosure 14. Surround 52 of coin container 32 overlies the front edge 54 of shelf 40. Referring now also to FIG. 4, pin wall 56 provides pin receiving space 58 into which second pin 50 is received when free edge 60 of surround 52 abuts front panel 42 at point 23. Spring 62 biases coin container 32 away from rear wall 27 of enclosure 14.

Referring now to FIG. 3, the invention is depicted in exploded view. Open frame 20 comprises straps 70, 72 and 74 which are mounted to sidewall 10 (shown in phantom) upon edge 60 of opening 62 at free ends 75, 76, 77, 78, 79 and 80. Open frame 20 depends from opening 62 into the interior of sidewall 10. Straps 70, 72 and 74 are formed to define open frame 20 as a polygon. Mounting holes 64 and 66 receive bolts such as 68 which retain enclosure 14 within open frame 20. Welding or other permanent fixature may be employed to retain enclosure 14 to open frame 20 though the possibility of field replacement of enclosure 14 is desired in the preferred embodiment.

Flange 12 surrounds opening 8 of enclosure 14. Preferably, flange 12 is curved generally co-diametric to the curve of sidewall 10.

First pin 36 depends from top wall 26 of enclosure 14. Second pin 50 depends from shelf 40. Coin drop opening 90 is provided in shelf 40. Stop 92 protrudes from enclosure 14 to provide an abutment for front panel 42. Coin return opening 94 is provided in front panel 42. Shield 38 depends from front panel 42 to provide pin receiving area 46. Slot 47 in front panel 42 provides a passageway for pin 36. Coin container 32 is receivable in enclosure 14 below shelf 40. Key lock 96 is selectively applied within surround 52 to capture second pin 50 thereby retaining coin container 32 to enclosure 14.

Figure 5:
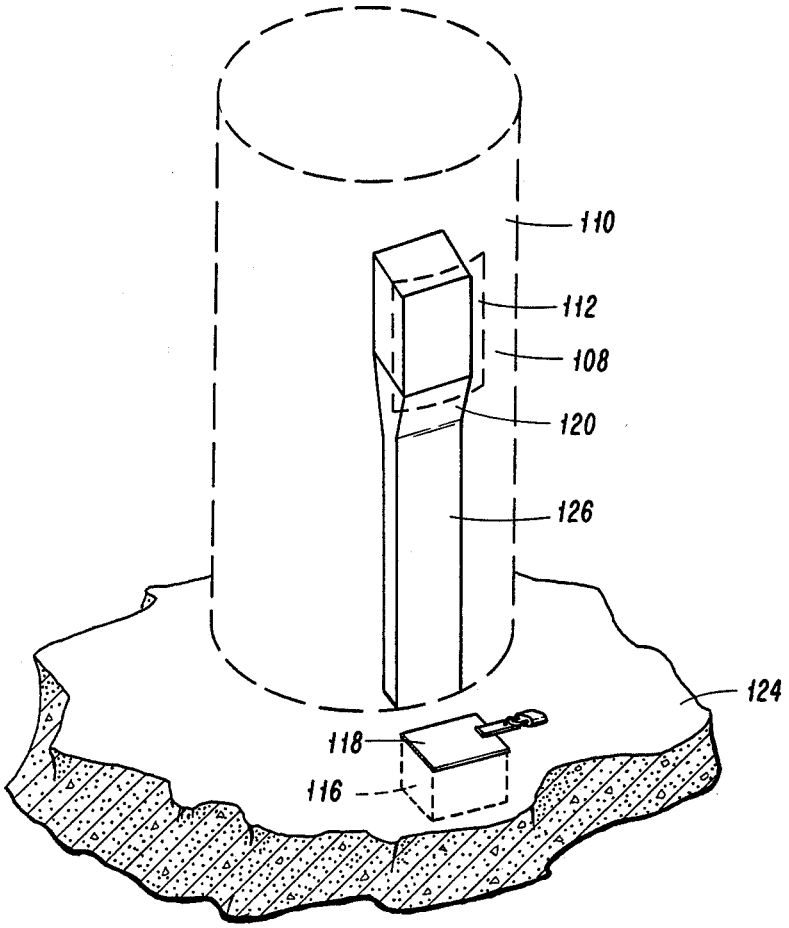
FIG. 5 is a perspective view of an alternate embodiment of the invention disclosing internal coin delivery structure.

An alternative embodiment is depicted in FIG. 5. Curved sidewall 110 is shown in phantom mounted to base 124. Base 124 houses vault 116. Base 124 is of substantially dense construction, such as formed concrete. Flange 112 depends from enclosure 114 to overlie portions of sidewall 110 surrounding enclosure 114. Enclosure 114 is mounted within sidewall 110 above plenum 120 which communicates between duct 126 and housing 114. Coins dropping through shelf 140 fall into plenum 120 to be passed through duct 126 to vault 116. Lockable access door 118 opens into vault 116.

Having thus described the invention, we claim:

1. In a coin operated vacuum cleaner having a canister and coin mechanism, the improvement comprising:
- a generally cylindrical canister body having a curved sidewall and end closures,
- said sidewall formed from a metal blank,
  - said blank having at least one polygonal opening therein,
- an open frame mounted within said at least one opening of said canister,
  - said open frame defining a polygonal webbing, open at one side thereof,
- a coin mechanism receiving enclosure mounted within said open frame at the open side thereof,
  - said coin mechanism receiving enclosure being polygonal and having at least one open side,
- said coin mechanism enclosure having a flange surrounding the periphery of said at least one open side thereof,
- said flange being generally curved co-diametrically to said sidewall,
- said flange overlying said sidewall of said canister body immediately surrounding said rectangular opening of said sidewall.

2. The invention of claim 1 wherein said frame comprises a plurality of straps,
- said straps having free ends,
- said straps are mounted to said opening at the free ends thereof.

3. The invention of claim 1 wherein said enclosure is selectively detachable from said frame.

4. The invention of claim 1 wherein said enclosure is an open box having perpendicular sides,
- said open frame defining a box receiving space.

5. The invention of claim 1 wherein said enclosure receives a coin mechanism and a coin container,
- said coin container being disposed below said coin mechanism,
- said enclosure being enclosed by a front panel attachment thereof,
- said front panel having a shield depending from the front thereof,
- said shield defining with said front panel a pin receiving space,
- said enclosure having a pin depending from the top thereof,
- said panel having a slot for passage of said pin through said front wall and into said pin receiving space.

6. The invention of claim 1 wherein
- said sidewall is mounted on a base,
- said sidewall has a duct associated therewith,
- said duct communicates with said enclosure at a second opening therein,
- said duct communicates with a coin receiving container within said base,
- said enclosure houses a coin receiving mechanism disposed above the communication of said duct with said enclosure whereby coins inserted within said coin mechanism will fall into said duct.

7. In a coin operated vacuum cleaner having a canister and coin mechanism, the improvement comprising:
- a canister body having sidewall and end closures,
- said sidewall
  - having at least one polygonal opening therein,
- an open frame mounted within said at least one opening of said canister,
  - said open frame defining a polygonal webbing, open at one side thereof,
- a coin mechanism receiving enclosure mounted within said open frame at the open side thereof,
  - said coin mechanism receiving enclosure being polygonal and having at least one open side,
- said coin mechanism receiving enclosure having a flange surrounding the periphery of said at least one side thereof, said flange overlying said sidewall of said canister body immediately surrounding said opening of said sidewall.

8. The invention of claim 7 wherein said frame comprises a plurality of straps, said straps having free ends, said straps are mounted to said opening at the free ends thereof.

9. The invention of claim 7 wherein said coin mechanism receiving enclosure is selectively detachable from said frame.

10. The invention of claim 7 wherein said enclosure is an open box having perpendicular sides, said open frame defining a box receiving space.

11. The invention of claim 7 wherein said enclosure receives a coin mechanism and a coin container, said coin container being disposed below said coin mechanism, said enclosure being enclosed by a front panel attachment thereof, said front panel having a shield depending from the front thereof, said shield defining with said front panel a pin receiving space, said enclosure having a pin depending from the top thereof, said panel having a slot for passage of said pin through said front wall and into said pin receiving space.

12. The invention of claim 7 wherein said sidewall is mounted on a base, said sidewall has a duct associated therewith.

said duct communicates with said enclosure at a second opening therein, said duct communicates with a coin receiving container contained within said base, said enclosure houses a coin receiving mechanism disposed above the communication of said duct with said enclosure whereby coins inserted within said coin mechanism will fall into said duct.

* * * * *